US005227215A

United States Patent [19]

Sklar

[11] Patent Number: 5,227,215

[45] Date of Patent: Jul. 13, 1993

[54] PRAYER SHAWL WEDDING CANOPY

[76] Inventor: Rissa Sklar, 4 Selwyn Dr., Broomall, Pa. 19008

[21] Appl. No.: 807,095

[22] Filed: Dec. 13, 1991

[51] Int. Cl.[5] ..... A41D 1/04; B32B 3/06; B32B 3/10

[52] U.S. Cl. ..... 428/102; 428/3; 2/69; 2/88; 2/89

[58] Field of Search ..... 428/3, 102; 2/69, 69.5, 2/88, 89

[56] References Cited

U.S. PATENT DOCUMENTS 4,485,494 12/1984 Segol ..... 2/115

4,912,780 4/1990 Falack ..... 2/102

*Primary Examiner*—Alexander S. Thomas

*Attorney, Agent, or Firm*—Elman Wilf & Fried

[57] ABSTRACT

A religious article that first functions as a canopy or chuppah for a wedding ceremony and then when cut into pieces serves as individual prayer shawls or tallitot for the couple. The religious article has two rows of heavy stitching, each adjacent to a longitudinal or latitudinal axis and perpendicular to the weft or warp of the material. The religious article also contains four reinforced corners and four additional reinforced areas each having holes provided therein. When the religious article is cut along the axis, forming two prayer shawls, each shawl has reinforced corners with holes through which are attached braided religious fringes or tzitziyot.

9 Claims, 4 Drawing Sheets

PRAYER SHAWL WEDDING CANOPY

FIELD OF THE INVENTION

This invention relates to religious articles. In one specific aspect this invention may be used as a canopy in a marriage ceremony and then transformed into separate fringed cloths that can be used as prayer shawls by the wedded couple.

BACKGROUND OF THE INVENTION

A wedding canopy (Hebrew: chuppah) is a symbolic covering traditionally suspended over the bridal couple during a Jewish wedding ceremony. The chuppah symbolizes both the house in which the couple will set up married life and the temporary nature of the couple's life on earth. It recalls the nomadic lifestyle of the biblical Hebrews.

A prayer shawl (Hebrew: tallit; Yiddish: tallis) is a rectangular cloth worn by Jews around the shoulders and upper arms during prayer in accordance with the Biblical injunction to wear a fringed garment. Not only does the prayer shawl bear fringes along both of its shorter sides, but it has a set of special fringes (Hebrew: tzitzit; Yiddish: tsitsis) each of which is braided through a hole provided at one of the four corners of the prayer shawl. The prayer shawl is traditionally woven with stripes running parallel to and near each of the shorter ends, and often an embroidered piece is affixed at the midsection of the one of the longer ends that is worn against the back of the neck. Other decorations and personalizations are optionally employed.

A garment (Hebrew tallit katan) that provides four of the aforementioned special fringes (tzitziyot) on a shirt or vest is shown in U.S. Pat. Nos. 4,485,494 and 4,912,780.

In the past, a wedding canopy has sometimes employed a single, large prayer shawl, raised upon four poles.

SUMMARY OF THE INVENTION

The present invention provides a religious article that serves a dual function. An article embodying the invention first serves as a canopy and then may be converted into a pair of prayer shawls.

The canopy is generally quadrangular in shape with four reinforced corners and four additional reinforced areas, all having holes formed therein through which specially braided fringes are attached. The canopy of the present invention is preferably designed with two rows of heavy continuous stitching sewn perpendicular to the weft or the warp of the canopy fabric. Each row is adjacent to any one longitudinal or latitudinal axis of the canopy. Optionally, traditional fringe may be continuously attached along the length of the two sides of the canopy that are perpendicular to the continuous stitching or to all four sides of the canopy.

After the wedding, the canopy is able to be cut in half along the axis having the adjacent heavy continuous stitching to form two four-cornered prayer shawls (Hebrew tallitot) each having the specially braided fringe, or tzitzit, attached to each corner. In this manner the prayer shawls have added significance in addition to traditional religious symbolism in that the shawls were an integral part of the couple's wedding ceremony.

Furthermore, the canopy is preferably decorated in such a way that when it is cut in two, each prayer shawl represents the design preference of the wearer. The prayer shawl may be woven with stripes running parallel to and near each of the shorter ends, and often an embroidered piece is affixed at the midsection of the side that is worn against the back of the neck. Optionally, the embroidered piece may be affixed at the midsection of the side opposite the side that is worn against the back of the neck. Other decorations and personalizations are optionally employed.

Accordingly, the present invention provides a novel religious article that serves as a symbolic covering over the couple during their wedding ceremony and then can be transformed into a pair of prayer shawls for subsequent use by the couple.

DETAILED DESCRIPTION

Figure 1:
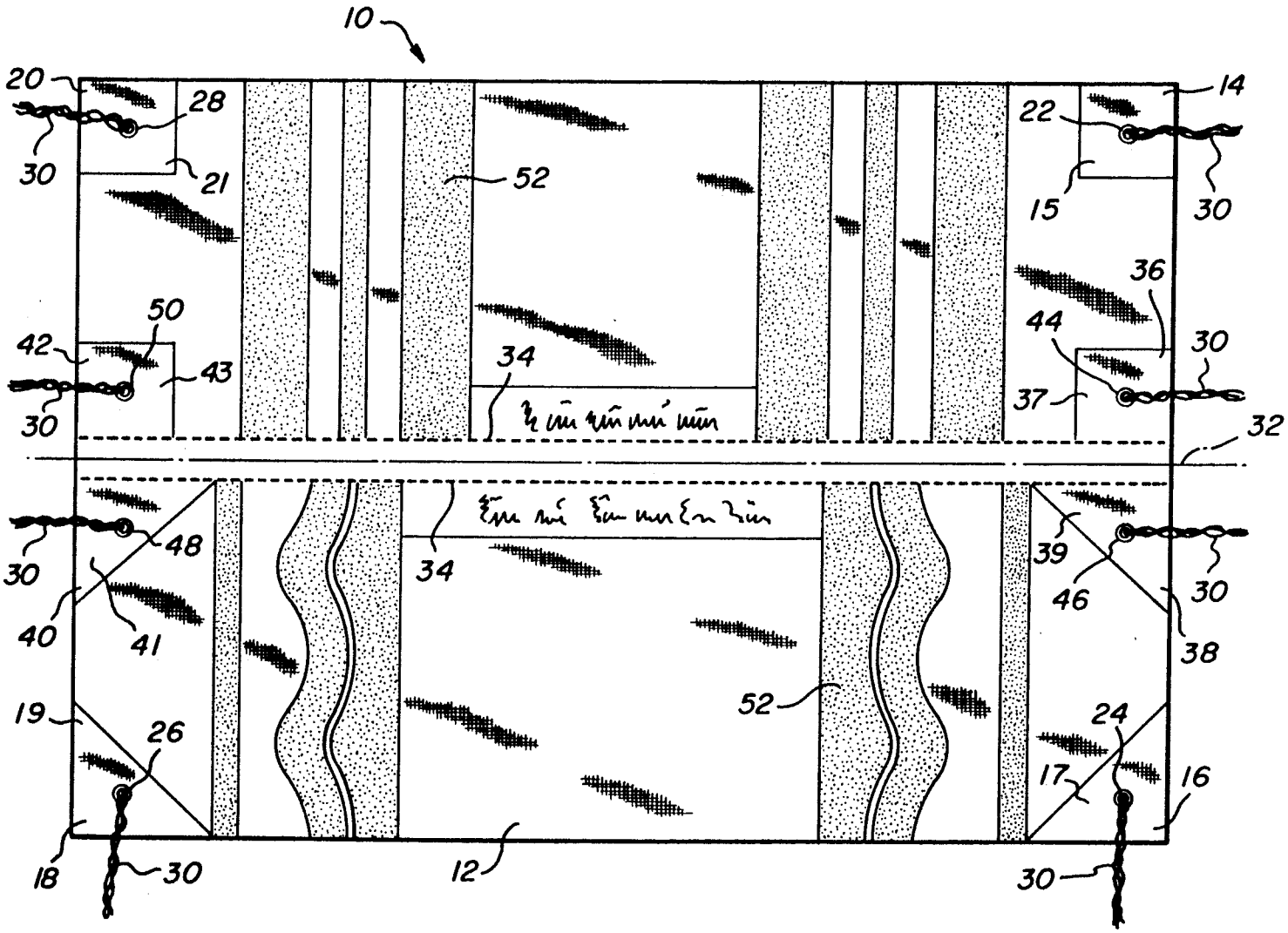
FIG. 1 is a plan view of an embodiment of the invention.

FIG. 1 shows a religious article 10 constructed in accordance with the present invention. The religious article 10 is formed from a substantially quadrangular (i.e. four-cornered) sheet of woven material, or fabric 12 with four corners 14, 16, 18 and 20. Each corner is provided with fabric reinforcement 15, 17, 19 and 21, and provides eyelets 22, 24, 26 and 28, respectively, for attaching tzitziyot 30 according to religious doctrine. On either side of a longitudinal or latitudinal axis 32 there is heavy continuous stitching 34 sewn the entire length or width of the religious article 10 and perpendicular to the weft or warp of fabric 12 (for illustrative purposes only, FIG. 1 shows the heavy stitching 34 adjacent to a longitudinal axis). Along the sides of the religious article 10 and adjacent to the stitching 34 are four additional areas 36, 38, 40 and 42. Each additional area 36, 38, 40 and 42 is provided with fabric reinforcement 37, 39, 41 and 43, and eyelets 44, 46, 48 and 50, respectively, similar to the construction of corners 14, 16, 18 and 20 and eyelets 22, 24, 26 and 28, for attaching tzitziyot 30 according to religious doctrine. Each corner section 14, 16, 18 and 20 and the additional areas 36, 38, 40 and 42 are reinforced with one or more additional layers of fabric. Each side of the religious article 10 is bound is some manner such as hemming, stitching, selvage or the like. Optionally, traditional fringe (not shown) may be continuously attached along the length of one or more sides of the religious article 10.

As shown, the reinforcement areas may be square, as at areas 15, 21, 37 and 43, or triangular, as at areas 17, 19, 39 and 41, or alternatively the reinforcement areas could be another shape not illustrated. For consistency of decoration of each of the prayer shawls that are eventually created from the religious article 10, it is desirable that each set of four reinforcement areas be the same or related in shape, but it is not necessary for the reinforcement areas of one prayer shawl to be the same shape as those of the other prayer shawl. Thus reinforcement areas 15, 21, 37 and 43 are preferably the same shape as or related in shape to each other. Similarly reinforcement areas 17, 19, 39 and 43 are preferably the same or related in shape. However it is not necessary for the shape of areas 15, 21, 37 and 43 to be the same as or even related to the shape of areas 17, 19, 39 and 43 because they are intended to be on different prayer shawls after the religious article 10 is separated into two.

The religious article 10 may be decorated to the preference of the users. For the purpose of decoration, the religious article 10 may be considered to be separate entities, separated by the axis 32. In this manner, two individuals may decorate each of the separate entities according to his or her tastes. Any decorations 52 comprising designs, religious scenes, words, symbols and the like may be woven into the fabric 12 or alternatively, embroidered, stitched or dyed onto the fabric 12. The prayer shawl may be woven with stripes running parallel to and near each of the shorter ends, and often an embroidered piece is affixed at the midsection of the side that is worn against the back of the neck. Optionally, the embroidered piece may be affixed at the midsection of the side opposite the side that is worn against the back of the neck. Other decorations and personalizations are optionally employed.

In particular, the religious article 10 may be of any size depending on its purpose. In the preferred embodiment, the religious article 10 is first used as a symbolic canopy, or chuppah above the couple during the wedding ceremony. The wedding canopy is then transformed into separate prayer shawls for the couple. The size of the wedding canopy can be of any size but generally depends on the preference of the couple who will wear the separate prayer shawls. In this manner, the dimensions of the fabric 12 are from about six to about eight feet by from about three to about six feet. The fabric may be of any conventional material but preferably of readily laundered material such as wool, silk, cotton, cotton-synthetic composites and the like. It is traditional to limit the material to those that conform to the rules of shatnetz.

Figure 2:
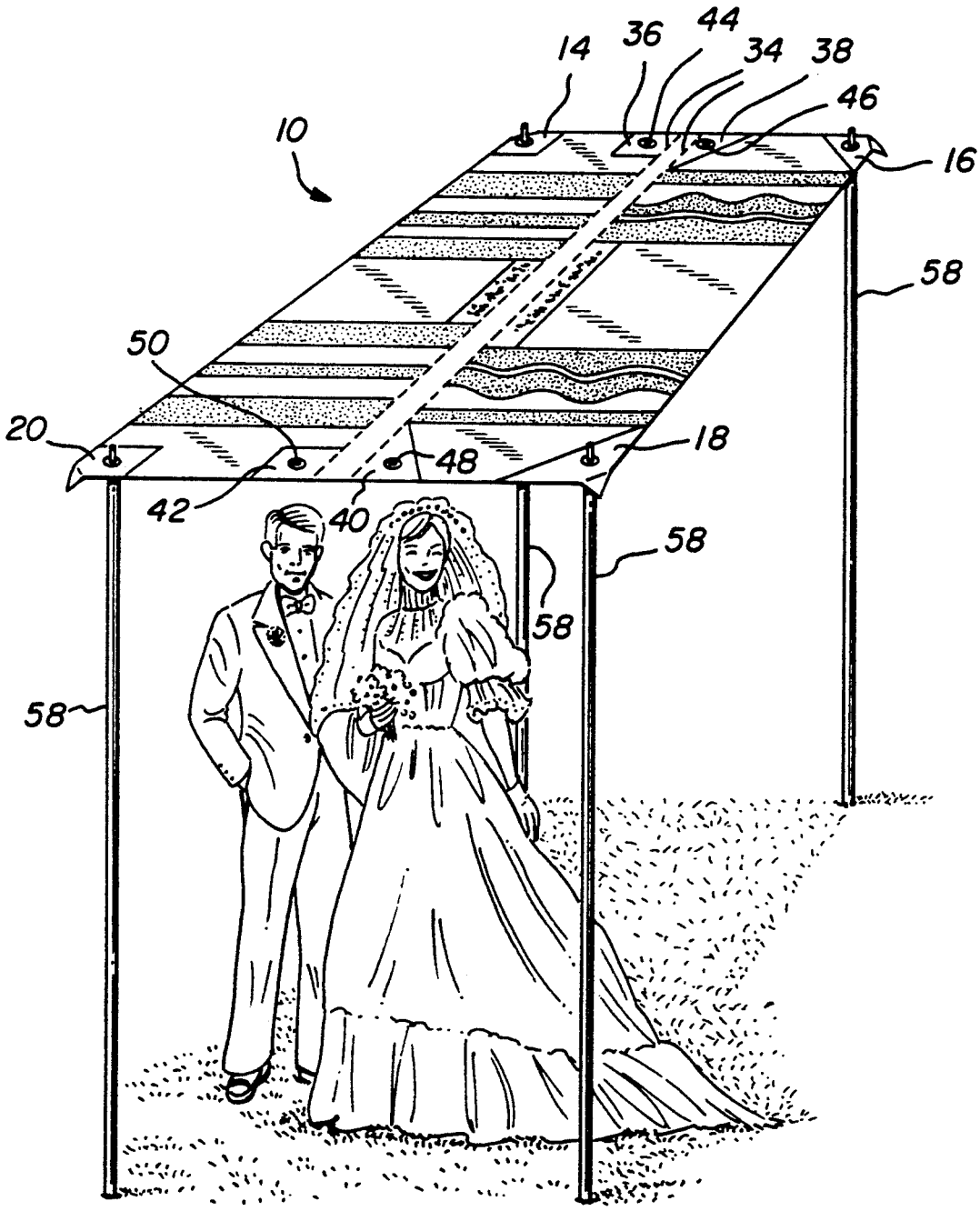
FIG. 2 is a perspective view of the embodiment of FIG. 1 in use as a wedding canopy.

To use the religious article 10 in the wedding ceremony, four poles 58 are provided and secured at the top to the reinforced corners 14, 16, 18 and 20. The poles 58 may contain clips, hooks or any other convenient means to attach the tops of the poles 58 to the reinforced corners 14, 16, 18 and 20. The poles 58 with the attached religious article 10 may be carried to the location of the ceremony and set into place by four individuals who are participating in the ceremony as chuppah holders. Optionally up to four additional poles may be provided, secured to areas 36, 38, 40 and 42. The religious article 10 is secured atop the poles 58 and covers the couple during the wedding ceremony as shown in FIG. 2.

Figure 3:
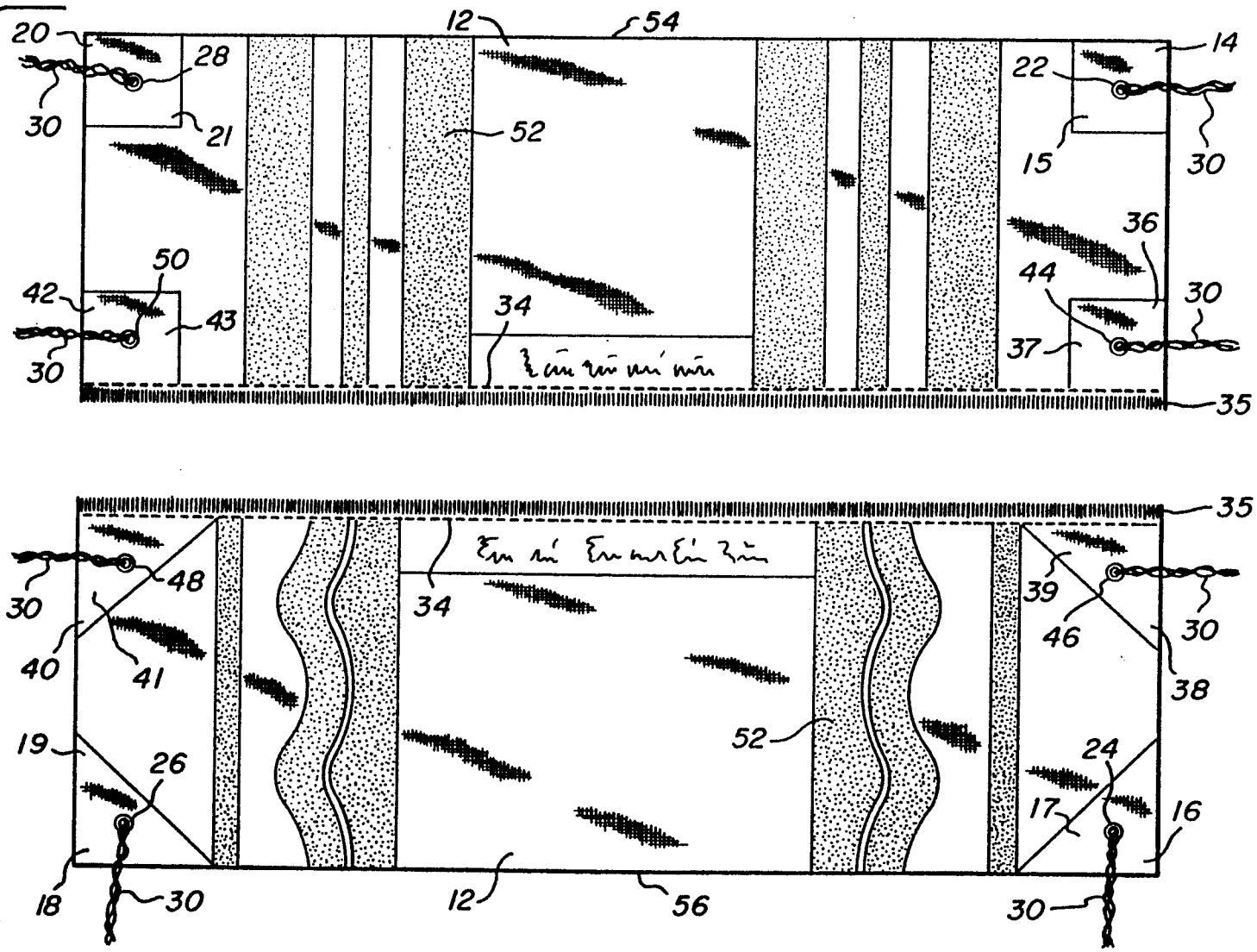
FIG. 3 is a plan view of the embodiment of FIG. 1 separated into two individual prayer shawls.
Figure 4:
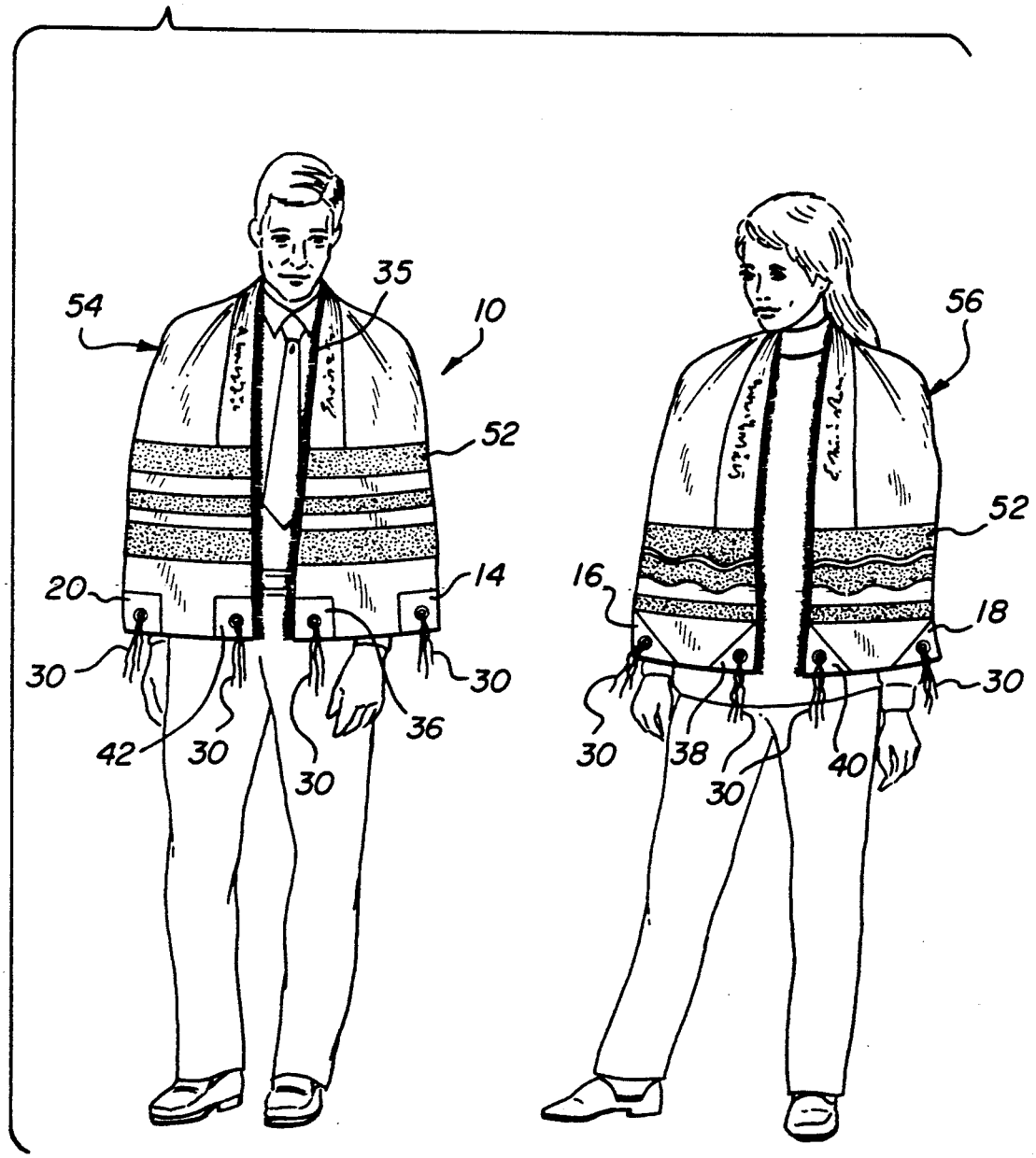
FIG. 4 is a perspective view of the prayer shawls of FIG. 3 in use.

After the wedding, the religious article 10 is preferably separated, as by cutting, along the axis 32 to form two separate and distinct prayer shawls 54 and 56 for use by the couple, as shown in FIGS. 3 and 4. The fabric 12 may unravel 35 from the cut along the axis 32 up to the stitching 34. The stitching 34 is sewn perpendicular to the weft or the warp of the fabric 12 so that the fabric 12 cannot unravel past the stitching 34. The distance between the two rows of stitching 34 determines the length of the unraveled fringe 35 that will occur after the religious article 10 is separated along the axis 32. The distance between the rows of stitching 34 may be as far apart as the wearer desires, but desirably, the distance is as short as possible, about ½ inch.

After the wedding canopy is cut in two, one part forms a first prayer shawl 54, which has corners 14, 36, 42 and 20 and corresponding eyelets 22, 44, 50 and 28. Similarly, the second prayer shawl 56 has corners 38, 16, 18 and 40 and corresponding eyelets 46, 24, 26 and 48. Fringe (tzitziyot 30) that attaches through eyelets 22, 24, 26, 28 and eyelets 44, 46, 48 and 50 may, but need not be affixed to the canopy before the wedding ceremony. The specially braided tzitziyot 30 may alternatively be ritually attached to the corresponding eyelets after the religious article 10 is separated to form prayer shawls 54 and 56. Each of the prayer shawls is a four-cornered garment with a specially braided tzitzit fringe 30 attached through a reinforced hole in each corner. Furthermore, each prayer shawl 54 and 56 may be individually designed to the preference of the wearer.

Modifications and changes from the specific form of the invention herein shown and described as the preferred embodiment will occur to those skilled in the art. All such modifications and changes not departing from the spirit of the invention are intended to be embraced within the scope of the appended claims.

Having thus described the invention, what it is claimed and desired to be protected by Letters Patent is:

1. A religious article comprising:

a generally quadrangular sheet of woven material having a first row of stitching adjacent to and on an upper side of an axis of the sheet, said axis running from a first side of the sheet to a second side of the sheet, and a second row of stitching adjacent to and on a lower side of said axis, each of the rows of stitching being adapted to prevent unraveling when the sheet is cut along said axis;

four corners, each corner being adapted for having a religious fringe braided therethrough, the first such corner being bounded by the first side and a third side of the sheet, located on an upper side of the first row of stitching, the second such corner being bounded by the second side and third side, the third such corner being bounded by the first side and a fourth side of the sheet, located on a lower side of the second row of stitching, and the fourth such corner being bounded by the second side and the fourth side; and four additional areas, each area being adapted for having a religious fringe braided therethrough, the first such additional area being bounded by the first row of stitching and the first side of the sheet, the second such additional area being bounded by the first row of stitching and the second side of the sheet, the third such additional area being bounded by the second row of stitching and the first side of the sheet, and the fourth such additional area being bounded by the second row of stitching and the second side of the sheet;

whereby the religious article is adapted for use as a wedding canopy and for being separated along said axis and thereafter being adapted for use as two prayer shawls.

2. The religious article of claim 1 wherein the material is wool, cotton, silk, synthetic material or a mixture thereof.

3. The religious article of claim 1 wherein decorations are woven into, or stitched or dyed or otherwise affixed onto the material.

4. The religious article of claim 1 wherein the means to attach the fringe are eyelets.

5. The religious article of claim 1 further comprising a religious fringe attached to each of the four corners.

6. The religious article of claim 5 further comprising a religious fringe attached to each of the four additional areas.

7. The religious article of claim 1 wherein the dimensions of the sheet are from about 6 to about 8 feet by from about 3 to about 6 feet.

8. The religious article of claim 1 wherein the first and second corners and the first and second additional areas each have reinforcing areas comprising a reinforcing layer of fabric and each of said reinforcing areas is the same shape as or related in shape to the other of said reinforcing areas.

9. The religious article of claim 1 wherein the third and fourth corners and the third and fourth additional areas each have reinforcing areas comprising a reinforcing layer of fabric and each of said reinforcing areas is the same shape as or related in shape to the other of said reinforcing areas.

* * * * *